US007744660B2

(12) United States Patent
Burrington et al.

(10) Patent No.: US 7,744,660 B2
(45) Date of Patent: Jun. 29, 2010

(54) GEL ADDITIVES FOR FUEL THAT REDUCE SOOT AND/OR EMISSIONS FROM ENGINES

(75) Inventors: James D. Burrington, Mayfield Village, OH (US); Daniel T. Daly, Solon, OH (US); Herman F. George, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 1009 days.

(21) Appl. No.: 11/506,298

(22) Filed: Jun. 6, 2006

(65) Prior Publication Data

US 2006/0272597 A1 Dec. 7, 2006

(51) Int. Cl.
*C10L 7/00* (2006.01)

(52) U.S. Cl. ..... 44/265

(58) Field of Classification Search ..... 44/265
See application file for complete search history.

(56) References Cited

U.S. PATENT DOCUMENTS

| | | | | |
|---|---|---|---|---|
| 2,310,305 | A | 2/1943 | Miller et al. | |
| 3,342,733 | A | 9/1967 | Robbins et al. | 252/33 |
| 4,382,005 | A | 5/1983 | Miller | 252/32.7 E |
| 4,601,799 | A | 7/1986 | Froberger et al. | 204/181.8 |
| 4,906,389 | A | 3/1990 | Brownawell et al. | 252/25 |
| 4,977,871 | A | 12/1990 | Brownawell et al. | 123/196 A |
| 5,944,858 | A * | 8/1999 | Wallace | 44/359 |
| 6,310,010 | B1 * | 10/2001 | Higton et al. | 508/192 |
| 6,652,608 | B1 * | 11/2003 | Orr | 44/360 |
| 6,843,916 | B2 * | 1/2005 | Burrington et al. | 210/416.5 |

FOREIGN PATENT DOCUMENTS

| | | | |
|---|---|---|---|
| EP | 0277729 | B1 | 8/1988 |
| EP | 0416907 | A2 | 3/1991 |
| EP | 0423744 | B1 | 4/1991 |
| EP | 0476197 | B1 | 3/1992 |
| EP | 0516461 | B1 | 12/1992 |
| EP | 0476197 | B1 | 1/1994 |
| EP | 0423744 | B1 | 2/1995 |
| EP | 0516461 | B1 | 2/1996 |
| WO | WO 2004/007653 | | 1/2004 |
| WO | WO 2004/072214 | | 8/2004 |

OTHER PUBLICATIONS

International Search Report from corresponding PCT Publication No. WO 2005/003265A1 published Jan. 13, 2005.
Abstract of JP Pub. No. 63270797 A, Japanese Patent Office & Japio Abstract (Nov. 8, 1988, Mitsubishi Oil Co.).
Abstract of Japan Patent No. 63270797, Mitsubishi Oil Co., Nov. 8, 1988, Derwent Publications Ltd. Abstract Class A97, AN 1988-358626, XP002297647 (Database WPI).
Search Report from corresponding PCT International Publication No. WO 2005/003265 A1; International Publication Date: Jan. 13, 2005.

* cited by examiner

*Primary Examiner*—Edward J Cain
(74) *Attorney, Agent, or Firm*—Christopher D. Hilker; Teresan W. Gilbert

(57) ABSTRACT

An additive gel for fuels that reduces the soot content in lubricating oil and/or emission in an engine. Further a process employing an additive gel for fuel in a fuel system to decrease the amount of soot in the lubricating oil of an engine and/or decrease the emissions from an engine.

16 Claims, No Drawings

GEL ADDITIVES FOR FUEL THAT REDUCE SOOT AND/OR EMISSIONS FROM ENGINES

BACKGROUND OF THE INVENTION

The present invention relates to a novel gel composition that is an additive for fuel that results in a decrease in the amount of soot in a lubricating oil in an engine and/or a decrease in the amount of emissions particularly soot, hydrocarbons and/or nitrogen oxides, (NO, $NO_2$, $N_2O$ collectively NOx) from an engine.

A complication facing modern compression ignited and spark ignited engines is the build up of soot in the lubricating oil due to oxidation and nitration by-products of the unburnt fuel or the lubricating oil itself and environmentally unfriendly emission. The buildup of this soot thickens the lubricating oil and can cause engine deposits. In severe operating conditions, the oil can thicken to the point of gelling. When the soot levels get to high, the increase in oil viscosity results in poor lubrication at critical wear points on the engine. This poor lubrication results in high wear, the formulation of higher amounts of piston deposits, a loss in fuel economy occurs and increased exhaust emissions. The net result is a shorter effective life of the lubricating oil and exhaust emissions.

Another complication in facing modern and future engines is the need for these engines to meet upcoming emission legislation. One solution has been to use exhaust after treatment systems to reduce emissions for the engine.

It is desirable to decrease the concentration of particles of soot in an engine oil using a novel gel composition as an additive to fuel. It is further desirable to decrease the emissions of soot, hydrocarbons and/or NOx from an engine using a novel gel fuel additive.

It has been found that a gel fuel additive in contact with the fuel of an engine can decrease the soot content in the oil of the lubricating system of the engine. It has been further found that an gel fuel additive can reduce the emissions from an engine in particular soot, hydrocarbons and/or NOx emissions.

This invention provides a way to provide enhanced performance to lubricating oil and to reduce engine emissions into the environment.

SUMMARY OF THE INVENTION

In accordance with the instant invention, it has been discovered that a gel additive for fuel can reduce the concentration of soot particles in a lubricating oil and/or reduce emissions from an engine.

In accordance with the present invention it has been discovered that a gel additive for fuel comprising a dispersant and a detergent ("gel") reduces the concentration of soot in the lubricating oil of an engine and/or decreases the emissions from an engine. Further the gel can contain an antioxidant and also may contain other fuel soluble additives. The gel additive for fuel is fuel soluble. The gel dissolves during use of the engine. In one embodiment the release of the gel components is a slow release.

In the present invention, suspended and/or dispersed soot in engine oil is decreased by a process comprising contacting a portion of the fuel in an engine with a gel. Further the present invention decreases the emissions and soot, hydrocarbons and/or NOx from an engine by a process comprising contacting a portion of the fuel of an engine with a gel.

The present invention provides for the use of a gel to decrease the amount of suspended/dispersed soot in lubricating oil in engines and/or to decrease the emissions in particular soot, hydrocarbons and/or NOx from an engine. The engines that can use the gel include, but are not limited to internal combustion engines such as spark ignited and/or a compression ignited, stationary and/or mobil power plant engines, generators, diesel and/or gasoline engines, on highway and/or off highway engines, two-cycle engines, aviation engines, piston engines, marine engines, railroad engines, biodegradable fuel engines and the like. In one embodiment the engine is equipped with after treatment devices, such as exhaust gas recirculation systems, catalytic converters, diesel particulate filters, NOx traps and the like.

DETAILED DESCRIPTION OF THE INVENTION

In accordance with the present invention the soot concentration is decreased from a lubricating oil in an engine thereby avoiding the deleterious effects on the engine from the soot, including viscosity and wear. Furthermore, the emissions of an engine is decreased thereby improving the environment.

The soot level in the lubricating oil and/or in the emissions from the engine is reduced by contacting the fuel with the gel. The gel is positioned within the fuel system, anywhere the gel will be in contact with the fuel. The gel is positioned anywhere that the circulating fuel contacts the gel such as full flow of fuel, bypass of the fuel or combinations therein. The location of the gel in the fuel system includes but is not limited to a filter, fuel filter, fuel bypass loop, fuel pump, injectors canister, housing, reservoir, pockets of a filter, canister in a filter, mesh in a filter, canister in a bypass system, mesh in a bypass system, canister in a tank, mesh in a tank, manifolds, inlets and/or outlets of fuel tank, fill fuel pipe, valves in fuel system, fuel chambers, fuel drain, intake air system, positive crank case ventilation system, air intake filter, exhaust gas recirculation (egr) system and the like. One or more locations can contain the gel. Further, if more than one location is used the gel can be identical, similar and/or a different formulation.

A necessary design feature for the application of the gel is that a portion to all of the gel components reach the combustion chamber. In one embodiment it is desirable to provide a container to hold the gel, such as a housing, a canister, a structural mesh or the like anywhere within the fuel system, for example, a housing in the filter of the fuel system. In one embodiment the design feature for the container is that at least a portion of the gel is in contact with the fuel and/or the components of the gel reach the combustion chamber.

In one embodiment, the gel is positioned anywhere in the fuel filter. The fuel filter is a desirable location to place the gel because the gel and/or spent gel can easily be removed, and then replaced with a new and/or recycled gel. In another embodiment the gel is positioned in a container anywhere in the fuel tank.

The gel or a portion of the gel needs to be in contact with the fuel. In one embodiment the gel is in contact with the fuel in the range of about 100% to about 1% of the fuel, in another embodiment the gel is in contact with the fuel in the range of about 75% to about 25% of the fuel and in another embodiment the gel is in contact with the fuel in the range of about 50% of the fuel.

The gel can be added also to the fuel by the fuel supplier at a refinery, terminal or at a refueling station by premixing the gel with the fuel. Alternatively, the vehicle operator can add the gel to the fuel tank by dosing the tank during refueling. The gel additive may be dosed to the fuel using a fuel dosing system that provides a controlled level of the additive to the fuel (storage) tank.

The release rate of the gel is determined primarily by the gel formulation. Also the location and the flow rate of the fuel and/or air affects the rate at which the gel dissolves. In one embodiment the gel is positioned in a location of a high flow rate such as about 50% to about 100% of the circulating fuel. In another embodiment the gel is positioned in a location of medium flow rate such as about 25% to about 75% of the circulating fuel. In another embodiment the gel is positioned in a location of low flow rate such as ≧1% to about 25% of the circulating fuel. For a given gel formulation the flow rate of the circulating fuel is directly proportional to the dissolution rate of the gel. Therefore as the flow rate decreases there is less dissolution of the gel and as the flow rate increases there is greater dissolution of the gel. The gel is positioned in a location desirable for the specified and desirable dissolution rate of the gel.

In one embodiment the gel's formulation may be composed of one or more components such as fuel soluble additives so that at the end of its service life there is none to little gel residue remaining. In another embodiment the gel's formulation maybe composed one or more component that selectively dissolve while at least a portion of the components remain at the end of its service life.

The gel for the fuel system comprises a dispersant, a detergent, and an antioxidant. Further the gel may optionally contain other fuel soluble additives.

In one embodiment the gel is represented by the formula A−B+C wherein A equals at least one component with at least one or more reactive or associative groups; wherein B contains a particle(s) or other component(s) with at least one group which reacts or associates with A to form a gel, and wherein C is at least one or more desired fuel additives. In one embodiment the gel has an antioxidant, a detergent and dispersant.

Component A includes but is not limited to antioxidants; dispersants; ashless dispersants; succinics; maleic anhydride styrene copolymers; maleated ethylene diene monomer copolymers; surfactants; emulsifiers; functionalized derivatives of each component listed herein and the like; and combinations thereof. Component A can be used alone or in combination. In one embodiment the preferred A is polyisobutenyl succinimide dispersant.

Component B includes but is not limited to dispersants, detergents, overbased detergents, carbon black, silica, alumina, titania, magnesium oxide, calcium carbonate, lime, clay, zeolites and the like; and combinations thereof. Component B can be used alone or in combination. In one embodiment Compound B is an overbased alkybenzenesulfonate detergent.

Component C includes but is not limited to the additives which include but are not limited to antioxidant, extreme pressure (EP) agents, wear reduction agents, viscosity index improvers, anti-foaming agents, combustion modifiers, cetane improver, fuel dispersants and the like. Component C can be used alone or in combination. In one embodiment Component C is at least one of an antioxidant and if component A is an antioxidant they are not the same antioxidant. In one embodiment Component C is at least one of a dispersant and if component A is a dispersant they are not the same dispersant.

The gel contains component A in the range of about 0.1% to about 95%, in one embodiment about 1% to about 70% and in another embodiment about 7% to about 50% of the gel. The gel contains component B in the range of about 0.1% and about 99%, in one embodiment about 5% to about 80% and in another embodiment about 10% to about 70% of the gel. The gel contains component C in the range of about 0% to about 95%, and inl one embodiment about 1% to about 70% and in another embodiment about 5% to about 60% of the gel.

In accordance with the present invention the gel formed is a fuel based gel. The gel is selected from the group comprising at least one of dispersants, dispersant precursors (such as alkyl or polymer succinic anhydrides), detergents, antioxidants, and mixtures thereof. Optionally, at least one soluble additive may be added to the gel as desired.

Other fuel soluble additives include, but are not limited to friction reducing agents, extreme pressure (EP) agents, wear reduction agents, viscosity index improvers, anti-foaming agents, anti-misting agents, cloud-point depressants, pour-point depressants, mineral or synthetic oils, anti-knock agents, lead scavengers, dyes, cetane improvers, rust inhibitors, bacteriostatic agents, gum inlhibitors, fluidizers, metal deactivators, demulsifiers, anti-icing agents, lubricity additives, friction modifiers, viscosity improvers, flow improvers, low temperature improvers, anti-static agents, valve-seat recession agents, intake valve deposit control additives, combustion chamber deposit control additives, fuel injector deposit control additives and the like. The fuel soluble additives may be used alone or in combination. The gel contains the fuel soluble additives in the range of about 0% to about 90%, and in one embodiment about 0.0005% to about 50% and in another embodiment about 0.0025% to about 30% of the gel.

Optionally, the fuel can also contain fuel-borne catalysts (organometallic compounds of e.g. Na, K, Co, Ni, Fe, Cu, Mn, Mo, V, Zn, Be, Pt, Pa, Ce, Cr, Al, Th, Se, Bi, Cd, Te, Sn, Ba, B, La, Ta, Ti, W, Zn, Ga, Pb, Ag, Au, Os, Ir) mixtures thereof and the like.

The gel typically contains small amounts (about 5-40%) of a hydrocarbon base, which include but are not limited to petroleum-based fuels, synthetics or mixtures thereof.

The gel comprises mixtures of two or more substances and exists in a semi-solid state more like a solid than a liquid. The rheological properties of a gel can be measured by small amplitude oscillatory shear testing. This technique measures the structural character of the gel and produces a term called the storage modulus (which represents storage of elastic energy) and the loss modulus (which represents the viscous dissipation of that energy). The ratio of the loss modulus/storage modulus, which is called the loss tangent, or "tan delta," is >1 for materials that are liquid-like and <1 for materials that are solid-like. The gels have tan delta values in one embodiment of about ≦0.75, in one embodiment of about ≦0.5 and in one embodiment of about ≦0.3.

In one embodiment the gels are those in which gelation occurs through the combination of a detergent and a dispersant in particular on overbased detergent and ashless succinide dispersed. In this embodiment, the ratio of the detergent to the dispersant is typically from about 10:1 to about 1:10; in one embodiment from about 5:1 to about 1:5; in one embodiment from about 4:1 to about 1:1; and in one embodiment from about 4:1 to about 2:1. In addition, the TBN (total base number) of the overbased detergents is in one embodiment at least 100, in one embodiment at least 300, in one embodiment at least 400 and in one embodiment 600. Where mixtures of overbased detergents are used, at least one should have a TBN value of at least 100. However, the average TBN of these mixtures may also correspond to a value greater than 100.

The dispersants include but are not limited to ashless-type dispersants, polymeric dispersants, Mannich dispersants, high molecular weight (Cn wherein n≧12) esters, carboxylic dispersants, amine dispersants, amine dispersants, polymeric dispersants and combinations thereof. The dispersant may be used alone or in combination. The dispersant is present in the range from about 0.1% to about 95% of the gel, preferably from about 1% to about 70% of the gel, and preferably from about 7% to about 50% of the gel.

The dispersant in the gel includes but is not limited to an ashless dispersant such as a polyisobutenyl succinimide and the like, Polyisobutenyl succinimide ashless dispersants are commercially-available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene diamine groups per molecule.

Ashless type dispersants are characterized by a polar group attached to a relatively high molecular weight hydrocarbon chain. Typical ashless dispersants include N-substituted long chain alkenyl succinimides, having a variety of chemical structures including typically:

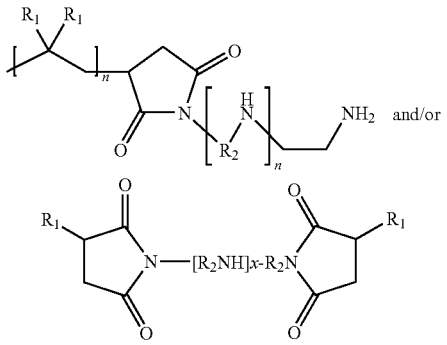

wherein each $R^1$ is independently an alkyl group, frequently a polyisobutyl group with a molecular weight of 500-5000, and $R^2$ are alkenyl groups, commonly ethylenyl ($C_2H_4$) groups. Succinimide dispersants are more fully described in U.S. Pat. No. 4,234,435 which is incorporated herein by reference. The dispersants described in this patent are particularly effective for producing gels in accordance with the present invention.

The Mannich dispersant are the reaction products of alkyl phenols in which the alkyl group contains at least about 30 carbon atoms with aldehydes (especially formaldehyde) and amines (especially polyalkylene polyamines). Mannich bases having the following general structure (including a variety of different isomers and the like) are especially interesting.

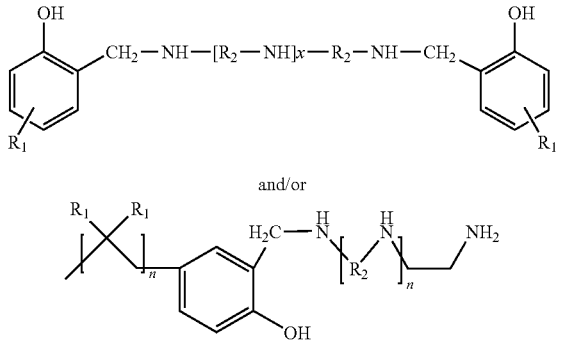

Another class of dispersants is carboxylic dispersants. Examples of these "carboxylic dispersants" are described in U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, and 3,702,300.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds.

The detergents include but are not limited to overbased sulfonates, phenates, salicylates, carboxylates and the like, overbased calcium sulfonate detergents which are commercially-available, overbased detergents containing metals such as Mg, Ba, Sr, Na, Ca and K and mixtures thereof. The detergents may be used alone or in combination. Detergents are described, for example, in U.S. Pat. No. 5,484,542 which is incorporated herein by reference. The detergents are present in the range from about 0.1% to about 99%, preferably from about 5% to about 80% and more preferably from about 10% to about 70% by weight of the gel.

Antioxidants include but are not limited to alkyl-substituted phenols such as 2,6-di-tertiary butyl-4-methyl phenol, phenate sulfides, phosphosulfurized terpenes, sulfurized esters, aromatic amines, diphenyl amities, alkylated diphenyl amines and hindered phenols.

The antioxidant includes amine antioxidants and is not limited to bis-nonylated diphenyl amine, nonyl diphenylamine, octyl diphenylamine, bis-octylated diphenylamine, bis-decylated diphenylamine, decyl diphenylamine and mixtures thereof.

The antioxidant includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butyl phenol, 4-(2-ethylhexyl)-2,6-di-tert-butylphenol, 4-octyl-2,6-di-tert-butylphenol, 4-nonyl-2,6-di-tert-btitylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4-methylenebis(6-tert-butyl-o-cresol), 4,4-methylenebis(2-tert-amyl-o-cresol), 2,2-methylbenebis(4-methyl-6-tert-butylphenol), 4,4-methylene-bis (2,6-di-tertbutylphenol) and mixtures thereof.

Another example of an antioxidant is a hindered, ester-substituted phenol, which can be prepared by heating a 2,6-dialkylphenol with an acrylate ester under base catalysis conditions, such as aqueous KOH. Anti oxidants may be used alone or in combination.

The antioxidants are typically present in the range of about 0.01% to about 95%, preferably about 0.01% to 95%, and more preferably about 1.0% to about 70% and most preferably about 5% to about 60% by weight of the gel.

The extreme pressure anti-wear additives include but are not limited to a sulfur or chlorosulphur EP agent, a chlorinated hydrocarbon EP agent, or a phosphorus EP agent, or mixtures thereof Examples of such EP agents are chlorinated wax, organic sulfides and polysulfides, such as benzyldisulfide, bis-(chlorobenzyl)dissulfide, dibutyl tetrasulfide, sulfurized sperm oil, sulfturized methyl ester of oleic acid sulfurized alkylphenol, sulfurized dispentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof The EP agent can be used alone or in combination. The EP agents are present in the range of about 0% to 10%, preferably from about 0.25% to about 5% and more preferably from about 0.5% to about 2.5% by weight of the gel.

The viscosity modifiers provide both viscosity improving properties and dispersant properties. Examples of dispersant-viscosity modifiers include but are not limited to vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers. The viscosity modifiers may be used alone or in combination.

Functionalized polymers can also be used as viscosity modifiers. Among the common classes of such polymers are olefin copolymers and acrylate or methacrylate copolymers. Functionalized olefin copolymers call be, for instance, interpolymers of ethylene and propylene which are grafted with an active monomer such as maleic anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkylstyrene, ethylene/propylene and ethylene/propylene/1,4-hexadiene polymers, can also be used as viscosity index improvers. The viscosity modifiers are known and commercially available. The viscosity modifiers are present in the ranged about 0% to about 20%, preferably about 5% to about 15% and more preferably about 7% to about 10% of the gel.

The antifoams include but are not limited to organic silicones such as poly dimethyl siloxane, poly ethyl siloxane, poly diethyl siloxane and the like. The antifoams may be used alone or in combination. The antifoams are normally used in the range of about 0% to about 1%, preferably about 0.02% to about 0.5% and more preferably 0.05% to about 0.2% by weight of the gel.

The anti knock agents, includes but is not limited to tetra-alkyl lead compounds, organomanganese compounds and the like. The anti knock agents may be used alone or in combination. The anti knock agents are present in the range of about 0% to about 90%, and in one embodiment about 0.0005% to about 50% and in another embodiment about 0.0025% to about 30% of the gel.

The lead scavengers, includes but is not limited to halo-alkanes and the like. The lead scavengers may be used alone or in combination. The lead scavengers are present in the range of about 0% to about 90%, and in one embodiment about 0.0005% to about 50% and in anotler embodiment about 0.0025% to about 30% of the gel.

The dyes, includes but is not limited to halo-alkanes and the like. The dyes may be used alone or in combination. The dyes are present in the range of about 0% to about 90%, and in one embodiment about 0.0005% to about 50% and in another embodiment about 0.0025% to about 30% of the gel.

The combustion modifiers, includes but is not limited to alkyl nitro compounds and the like. The combustion modifiers may be used alone or in combination. The combustion modifiers are present in the range of about 0% to about 90%, and in one embodiment about 0.0005% to about 50% and in another embodiment about 0.0025% to about 30% of the gel.

The cetane improvers, includes but is not limited to alkyl nitrates and the like. The cetane improvers may be used alone or in combination. The cetane improvers are present in the range of about 0% to about 90%, and in one embodiment about 0.0005% to about 50% and in another embodiment about 0.0025% to about 30% of the gel.

The rust inhibitors, includes but is not limited to alkylated succinic acids and anhydrides derivatives thereof, organo phosphonates and the like. The rust inhibitors may be used alone or in comibination. The rust inhibitors are present in the range of about 0% to about 90%, and in one embodiment about 0.0005% to about 50% and in another embodiment about 0.0025% to about 30% of the gel.

The bacterostatic agents, includes but is not limited to formaldehyde, gluteraldehyde and derivatives, kathan and the like. The bacterostatic agents may be used alone or in combination. The bacterostatic agents are present in the range of about 0% to about 90%, and in one embodiment about 0.0005% to about 50% and in another embodiment about 0.0025% to about 30% of the gel.78

The gum inhibitors, includes but is not limited to diphenyl amine and the like. The gum inhibitors may be used alone or in combination. The gum inhibitors are present in the range of about 0% to about 90%, and in one embodiment about 0.0005% to about 50% and in another embodiment about 0.0025% to about 30% of the gel.

The fluidizers, includes but is not limited to polyisobutenyl amine, polypropylene oxide, and the like. The fluidizers may be used alone or in combination. The fluidizers are present in the range of about 0% to about 90%, and in one embodiment about 0.0005% to about 50% and in another embodiment about 0.0025% to about 30% of the gel.

The metal deactivators, includes but is not limited to derivatives of benzotriazoles such as tolyltriazole, N,N-bis(heptyl)-ar-methyl-1H-benzotriazole-1-methaniamine, N,N-bis(nonyl)-ar-methyl-1H-Benzotriazole-1-methanamine, N,N-bis(decyl)-ar-methyl-1H-Benzotriazole-1-methanamine, N,N-bis(undecyl)-ar-methyl-1H-benzotriazole-1-methanamine, N,N-bis(dodecyl)-ar-methyl-1H-Bbenzotriazole-1-metlianamine N,N-bis(2-ethylhexyl)-ar-methyl-1H-Bhenzotriazole-1-methanamine and mixtures thereof. In one embodiment the metal deactivator is N,N-bis(2-ethylhexyl)-ar-methyl-1H-benzotriazole 1-methanamine; 1,2,4-triazoles, benzimidazoles, 2-alkyldithiobenzimidazoles; 2-alkyldithiobenzothiazoles; 2-(N,N-dialkyldithiocarbamoyl)benzothiazoles; 2,5-bis(alkyl-dithio)-1,3,4-thiadiazoles such as2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole and mixtures thereof; 2,5-bis(N,N-dialkyldithiocarbamoyl)-1,3,4-thiadiazoles; 2-alkyldithio-5-mercapto thiadiazoles; and the like. The metal deactivators may be used alone or in combination. The metal deactivators are present in the range of about 0% to about 90%, and in one embodiment about 0.0005% to about 50% and in another emnbodiment about 0.0025% to about 30% of the gel.

The anti-icing agents, includes but is not limited to diethylene glycol and the like. The anti-icing agents may be used alone or in combination. The anti-icing agents are present in the rainge of about 0% to about 90%, and in one embodiment about 0.0005% to about 50% and in another embodiniexit about 0.0025% to about 30% of the gel.

The demulsifiers, includes but is not limited to polyethylene and polypropylene oxide copolymers and the like. The demulsifiers may be used alone or in combination. The demulsifiers are present in the range of about 0% to about 90%, and in one embodiment about 0.0005% to about 50% and in another embodiment about 0.0025% to about 30% of the gel.

The lubricity additives, includes but is not limited to glycerol monooleate, sorbitanmono oleate and the like. The lubricity additives may be used alone or in combination. The lubricity additives are present in the range of about 0% to about 90%, and in one embodiment about 0005% to about 50% and in another embodiment about 0.0025% to about 30% of the gel.

The friction modifiers, includes but is not limited to oleic acid and the like. The friction modifiers may be used alone or in combination. The friction modifiers are present in the range of about 0% to about 90%, and in one embodiment about 0.0005% to about 50% and in another embodiment about 0.0025% to about 30% of the gel.

The flow improvers, includes but is not limited to ethylene vinyl acetate copolymers and the like. The flow improvers may be used alone or in combination. The flow improvers are present in the range of about 0% to about 90%, and in one embodiment about 0.0005% to about 50% and in another embodiment about 0.0025% to about 30% of the gel.

The low temperature improvers, includes but is not limited to wax anti-settling agents, ethylene vinyl acetate copolymers and the like. The low temperature improvers may be used alone or in combination. The low temperature improvers are present in the range of about 0% to about 90%, and in one embodiment about 0.0005% to about 50% and in another embodiment about 0.0025% to about 30% of the gel.

The cloud point depressants, includes but is not limited to alkylphenols and derivatives thereof, ethylene vinyl acetate copolymers and the like. The cloud point depressants may be used alone or in combination. The cloud point depressants are present in the range of about 0% to about 90%, and in one emribodimtienit about 0.0005% to about 50% and in another embodiment about 0.0025% to about 30% of the gel.

The pour point depressant, includes but is not limited to alkylphenols and derivatives thereof, ethylene vinyl acetate copolymers and the like. The pour point depressant may be used alone or in combination. The pour point depressant are present in the range of about 0% to about 90%, and in one embodiment about 0.0005% to about 50% and in another embodiment about 0.0025% to about 30% of the gel.

The anti-static agents, includes but is not limited to polysiloxane polyether and the like. The anti-static agents may be used alone or in combination. The anti-static agents are present in the range of about 0% to about 90%, and in one embnbodiment about 0.0005% to about 50% and in another embodiment about 0.0025% to about 30% of the gel.

The valve seat recession agents, includes but is not limited to potassium or sodium bearing surfactanits and the like. The valve seat recession agents may be used alone or in combination. The valve seat recession agents are present in the range of about 0% to about 90%, and in one embodiment about 0.0005% to about 50% and in another embodiment about 0.0025% to about 30% of the gel.

The intake valve deposit control additives, includes but is not limited to poly isobutylene amines and the like. The intake valve deposit control additives may be used alone or in combination. The intake valve deposit control additives are present in the range of about 0% to about 90%, and in one embodiment about 0.0005% to about 50% and in another embodiment about 0.0025% to about 30% of the gel.

The combustion chamber deposit control additives, includes but is not limited to polyetheramines and the like. The combustion chamber deposit control additives may be used alone or in combination. The combustion chamber deposit control additives are present in the range of about 0% to about 90%, and in one embodiment about 0.0005% to about 50% and in another embodiment about 0.0025% to about 30% of the gel.

The fuel injector deposit control additives, includes but is not limited to alkylamines and the like. The fuel injector deposit control additives may be used alone or in combination. The fuel injector deposit control additives are present in the range of about 0% to about 90%, and in one embodiment about 0.0005% to about 50% and in another embodiment about 0.0025% to about 30% of the gel.

The fuel dispersant additives, includes but is not limited to succinimides and the like. The fuel dispersant additives may be used alone or in combination. The fuel dispersant additives are present in the range of about 0% to about 90%, and in one embodiment about 0.0005% to about 50% and in another embodiment about 0.0025% to about 30% of the gel.

Optionally, an inert carrier can be used if desired. Furthermore, other active ingredients, which provide a beneficial and desired function to the soot being decreased, can also be included in the gel additive. In addition, solid, particulate additives such as the PTFE, $MoS_2$ and graphite can also be included.

The normally liquid hydrocarbon fuel may be a hydrocarbonaceous petroleum distillate fuel such as motor gasoline as defined by ASTM Specification D481 or diesel fuel or fuel oil as defined by ASTM Specification D975. Normally liquid hydrocarbon fuels comprising non-hydrocarbonaceous materials such as alcohols, ethers, organo-nitro compounds and the like (e.g., methanol, ethanol, diethyl ether, methyl ethyl ether, methyl tert-butyl ether, nitromethanie) are also include as are liquid fuels derived from vegetable or mineral sources such as corn, alfalfa, shale and coal. Normally liquid hydrocarbon fuels, which are mixtures of one or more hydrocarbonaceous fuels and one or more non-hydrocarbonaceous materials, are also included. Examples of such mixtures are combination of gasoline and ethanol, diesel fuel and ether, diesel fuel and methyl esters of vegetable or animal oils. In one embodiment, the fuel is a chlorine-free or low-chlorine fuel characterized by sulfur content of no more there about 10 ppm. Included are fuels known as gas to liquid fuels, GTL. The fuel may also be lead containing or lead free. The fuel may also be an emulsified fuel, either a macro-emulsion, a micro-emulsion or combinations thereof.

In an embodiment of this invention, the internal combustion engine is equipped with an exhaust after-treatment device. Exhaust after-treatment devices are used for modern engines to meet the new low exhaust emission standards. These systems are used to reduce undesirable emissions in the exhaust gases of internal combustion vehicle engines and are located in the exhaust system collected to the engines.

In one embodiment of this invention, catalysts are employed in the exhaust systems of internal combustion engines to convert carbon monoxide, hydrocarbons and nitrogen oxides (NOx) produced during engine operation into more desirable gases such as carbon dioxide, water and nitrogen. Among the broad range of available catalysts for this purpose, are oxidation catalysts, reduction catalysts and the so-called three-way converters. Oxidation catalysts can efficiently oxidize unburnt exhaust gas components and convert them into harmless substances. Three-way converters are able to simultaneously convert all three harmful substances provided that the internal combustion engine is operated close to the stoichiometric air/fuel ratio. These catalyst systems typically contain noble metals from the platinum group of the Periodic System of Elements. Particular metals used are platinum, palladium and rhodium.

In another embodiment, the exhaust after-treatment device involves a NOx trap. NOx traps, i.e. materials that are able to absorb nitrogen oxides during lean-burn operation and are able to release them when the oxygen concentration in the exhaust gas is lowered are porous support materials loaded with alkali metal or alkaline earth metals combined with precious metal catalysts such as platinum and the like.

In still another embodiment, the exhaust after-treatment device contains a diesel engine exhaust particulate filter hereinafter referred to as "DPF's". DPF's have a multiplicity of interconnected thin porous walls that define at least one inlet surface and one outlet surface on the filter and a multiplicity of hollow passages or cells extending through the filter from the inlet surface to an outlet surface. The interconnected thin porous walls allow the fluid to pass from the inlet surface to the outlet surface while restraining a desired portion of the solid particulates in the fluid from passing through. DPF's are typically installed in a housing which is inserted like a muffler or catalytic converter into the exhaust system of diesel engine equipped vehicle.

Specific Embodiment

In order to more thoroughly illustrate the present invention, the following examples are provided.

A. Gel Preparation

A representative gel, known as Composition X is prepared by first mixing components A and C, and then adding component B with mixing in the proportions listed below. The resulting mixture is heated at 120° overnight to produce the final gel. The resulting gel is one of the formulations of the present invention.

| Component | Chemical Description | % wt of Composition X |
|---|---|---|
| A | Polyisobutenyl (2000 Mn) succinimide Dispersant | 20% |
| B | 400 TBN Overbased Alkylbenzenesulfonate Detergent | 60% |
| C | Nonylated Diphenylamine Antioxidant | 20% |

From the above description and examples of the invention those skilled in the art will perceive improvements, changes and modifications in the invention. Such improvements, changes and modifications within the skill of the art are intended to be covered by the appended claims.

We claim:

1. A composition comprising a gel used in an application selected from the group consisting of decreasing the amount of soot in the lubricating oil engine, decreasing the amount of emissions in the engine exhaust and combinations thereof; wherein the emissions reduced are selected from the group consisting of soot, NOx, hydrocarbons and combinations thereof; and wherein the gel comprises a detergent, an ashless succinimide dispersant and an antioxidant, where the ratio of detergent to dispersant is of about 10:1 to about 1:10, and wherein the gel has a tan delta value of less than or equal to 0.75; and wherein the composition further comprises at least one fuel additive selected from the group consisting of friction reducing agents, anti-misting agents, cloud-point depressants, pour-point depressants, mineral or synthetic oils, anti-knock agents, lead scavengers, dyes, cetane improvers, rust inhibitors, bacteriostatic agents, gum inhibitors, fluidizers, metal deactivators, demulsifiers, anti-icing agents, lubricity additives, friction modifiers, viscosity improvers, flow improvers, low temperature improvers, anti-static agents, valve-seat recession agents, intake valve deposit control additives, combustion chamber deposit control additives, fuel injector deposit control additives and combinations thereof; and wherein the composition further comprises one or more fuel-borne catalysts comprising organometallic compounds of Na, K, Co, Ni, Fe, Cu, Mn, Mo, V, Zn, Be, Pt, Pa, Ce, Cr, Al, Th, Se, Bi, Cd, Te, Sn, Ba, B, La, Ta, Ti, W, Zn, Ga, Pb, Ag, Au, Os, Ir and combinations thereof in the fuel.

2. A process comprising contacting in the range of a portion to all of the components of a gel composition with a fuel in an engine during the use of the engine such that at least a portion of all of the components of the gel are present in the combustion chamber of the engine resulting in the reduction of soot in the engine oil, emissions in the engine exhaust and combinations thereof and wherein the emissions reduced in the exhaust are selected from the group consisting of soot, NOx, hydrocarbons and combinations thereof; and wherein the gel composition comprises a detergent, an ashless succinimide dispersant and an antioxidant, where the ratio of detergent to dispersant is of about 10:1 to about 1:10, and wherein the gel has a tan delta value of less than or equal to 0.75; and wherein the composition further comprises at least one fuel additive selected from the group consisting of friction reducing agents, anti-misting agents, cloud-point depressants, pour-point depressants, mineral or synthetic oils, anti-knock agents, lead scavengers, dyes, cetane improvers, rust inhibitors, bacteriostatic agents, gum inhibitors, fluidizers, metal deactivators, demulsifiers, anti-icing agents, lubricity additives, friction modifiers, viscosity improvers, flow improvers, low temperature improvers, anti-static agents, valve-seat recession agents, intake valve deposit control additives, combustion chamber deposit control additives, fuel injector deposit control additives and combinations thereof.

3. A process comprising contacting in the range of a portion to all of the components of a gel composition with a fuel in an engine during the use of the engine resulting in the reduction of soot in the engine oil and/or emissions in an engine exhaust; and wherein the gel composition comprises a detergent, an ashless succinimide dispersant and an antioxidant, where the ratio of detergent to dispersant is of about 10:1 to about 1:10, and wherein the gel has a tan delta value of less than or equal to 0.75; and wherein the composition further comprises at least one fuel additive selected from the group consisting of friction reducing agents, anti-misting agents, cloud-point depressants, pour-point depressants, mineral or synthetic oils, anti-knock agents, lead scavengers, dyes, cetane improvers, rust inhibitors, bacteriostatic agents, gum inhibitors, fluidizers, metal deactivators, demulsifiers, anti-icing agents, lubricity additives, friction modifiers, viscosity improvers, flow improvers, low temperature improvers, anti-static agents, valve-seat recession agents, intake valve deposit control additives, combustion chamber deposit control additives, fuel injector deposit control additives and combinations thereof.

4. The process of claim 3 wherein the gel is positioned to contact the fuel in an area selected from the group consisting of full flow oil, bypass of oil, in the reservoir and combinations thereof.

5. The process of claim 3 wherein the gel is located in an area selected from the group consisting of a filter, fuel filter, fuel bypass loop, fuel pump, injectors canister, housing, reservoir, pockets of a filter, canister in a filter, mesh in a filter, canister in a bypass system, mesh in a bypass system, canister in a tank, mesh in a tank, manifolds, inlets and/or outlets of fuel tank, fill fuel pipe, valves in fuel system, fuel chambers, fuel drain, intake air system, positive crank case ventilation system, air intake filter, exhaust gas recirculation (egr) system and combinations thereof.

6. The process of claim 5 wherein the gel is located in more than one location then the gel formulation can be identical, similar, different or combinations thereof.

7. The process of claim 3 wherein the gel is in contact with the fuel in the engine's fuel system in the range of about 100% to 1% of the fuel in the engine.

8. The process of claim 3 wherein the gel at the end of its service life contains in the range of none to a portion of the components in the gel due to selective dissolution of the gel.

9. The process of claim 3 comprising adding the components of the gel to the fuel in the engine's fuel system in the range of all at the same time to a portion of the components of the gel over its service life.

10. A fuel filter for an engine fuel system comprising a housing, a filter for removing particulate matter from a fuel filter and a container with a gel wherein the gel comprises a dispersant, a detergent, and an antioxidant and results in the reduction of soot, emissions or combinations thereof from an engine; and wherein the emissions reduced are selected from the group consisting of soot, NOx, hydrocarbons and combinations thereof; and wherein the gel has a tan delta value of less than or equal to 0.75.

11. A gel containment device for a fuel system comprising a housing in a fuel system and a container with a gel in the housing, and wherein the gel comprises a dispersant, a detergent and an antioxidant for the soot reduction, emissions reduction or combinations thereof from an engine; and wherein the emissions reduced are selected from the group consisting of soot, NOx, hydrocarbons and combinations thereof; and wherein the gel has a tan delta value of less than or equal to 0.75.

12. A fuel for an internal combustion engine comprising;

a) a fuel at 20° C. and b) a gel comprising a dispersant, a detergent and an antioxidant, resulting in the soot reduction, emissions reduction or combinations thereof from the engine; wherein the emissions reduced are selected from the group consisting of soot, NOx, hydrocarbons and combinations thereof; and wherein the gel has a tan delta value of less than or equal to 0.75.

13. An internal combustion engine comprising;

a) an internal combustion engine, b) a liquid fuel at 20° C., c) a gel comprising a dispersant, a detergent and an antioxidant, d) a reservoir containing the gel and supplying the gel composition to the fuel in the fuel system of the engine resulting in soot reduction, emissions reduction or combinations thereof; wherein the emissions reduced are selected from the group consisting of soot, NOx, hydrocarbons and combinations thereof; and wherein the gel has a tan delta value of less than or equal to 0.75.

14. An internal combustion engine according to claim 13, including an exhaust after treatment device that traps particulate (e.g. diesel particulate trap), oxidizes and/or reduces selected exhaust gas components, or traps or converts NOx to other compounds, or said engine is equipped with a system to recirculate exhaust gases to the intake air supply for said engine.

15. A fuel according to claim 12, wherein said fuel is characterized as a liquid fuel including diesel fuel, gasoline fuel, liquefied petroleum gas (LPG) an emulsified fuel, or combination thereof.

16. A fuel according to claim 12 wherein said fuel is characterized as a gaseous fuel, including natural gas, methane, ethane, propane or combinations thereof.

* * * * *